US010239029B2

(12) United States Patent
Khayman

(10) Patent No.: US 10,239,029 B2
(45) Date of Patent: Mar. 26, 2019

(54) AERATION DEVICE

(71) Applicant: Yevgeniy Khayman, Staten Island, NY (US)

(72) Inventor: Yevgeniy Khayman, Staten Island, NY (US)

( * ) Notice: Subject to any disclaimer, the term of this patent is extended or adjusted under 35 U.S.C. 154(b) by 226 days.

(21) Appl. No.: 15/153,030

(22) Filed: May 12, 2016

(65) Prior Publication Data

US 2017/0320023 A1 Nov. 9, 2017

Related U.S. Application Data

(63) Continuation-in-part of application No. 29/563,220, filed on May 3, 2016, now Pat. No. Des. 805,841.

(51) Int. Cl.

*B01F 13/00* (2006.01)
*B01F 15/00* (2006.01)
*B01F 3/04* (2006.01)

(52) U.S. Cl.

CPC ..... *B01F 13/0033* (2013.01); *B01F 3/04248* (2013.01); *B01F 15/00253* (2013.01); *B01F 15/00519* (2013.01); *B01F 2215/0072* (2013.01)

(58) Field of Classification Search

CPC ..... B01F 3/04794; B01F 13/0033; B01F 3/04248; B01F 15/00519; B01F 15/00253; B01F 2215/0072

See application file for complete search history.

(56) References Cited

U.S. PATENT DOCUMENTS 4,494,452 A * 1/1985 Barzso ..... B01F 3/04794 261/122.1
5,154,112 A * 10/1992 Wettern ..... B01F 3/04794 215/228
5,595,104 A 1/1997 Delaplaine
5,713,263 A 2/1998 Burks
6,508,163 B1 1/2003 Weatherill
8,101,222 B2 1/2012 Burroughs et al.
8,430,023 B2 4/2013 Hynes
8,523,019 B2 * 9/2013 Drobot ..... B01F 5/0428 222/152
8,561,970 B1 * 10/2013 Mills ..... B01F 13/002 261/124

(Continued)

OTHER PUBLICATIONS

Universal Air Filter "Metal Mesh Air Filters" published Jun. 19, 2012 accessed at <https://web.archive.org/web/20120619062839/https://www.uaf.com/products/metal-mesh-air-filters/>.*

*Primary Examiner* — Amber R Orlando
*Assistant Examiner* — Stephen Hobson
(74) *Attorney, Agent, or Firm* — Olav M. Underdal; IDP Patent Services

(57) ABSTRACT

An aeration device includes a housing; a pump module mounted inside the housing and configured to provide a fluid flow; a tube connector mounted inside the housing and fluidly connected to the pump module; an aerator tube configured to be attachable to the tube connector; and a gripping recess mounted inside the housing such that the aerator tube is receivable within the gripping recess. The aerator tube is configured to receive the fluid flow from the pump module and deliver the fluid flow to a liquid in a vessel. The aerator device is configured to rest on a top rim of a vessel during operation of the pump module.

15 Claims, 10 Drawing Sheets

(56) References Cited

U.S. PATENT DOCUMENTS

| | | | | |
|---|---|---|---|---|
| 8,978,546 | B2 * | 3/2015 | Chen | B67D 1/0085 261/109 |
| 9,440,199 | B2 * | 9/2016 | Stevenson | B01F 13/002 |
| 9,579,612 | B2 * | 2/2017 | Stevenson | B01F 3/04794 |
| 9,630,153 | B2 * | 4/2017 | Lincoln | B01F 3/04787 |
| 2004/0123620 | A1 * | 7/2004 | Porter | F25D 31/007 62/457.3 |
| 2007/0256568 | A1 | 11/2007 | Nudi et al. | |
| 2010/0058933 | A1 * | 3/2010 | Cheng | B01F 3/04595 99/323.1 |
| 2011/0024461 | A1 | 2/2011 | Kilduff et al. | |
| 2011/0154994 | A1 | 6/2011 | Sabadicci | |
| 2011/0297001 | A1 | 12/2011 | DeJohn | |
| 2011/0297006 | A1 * | 12/2011 | Belcher | |
| 2012/0111202 | A1 * | 5/2012 | Bregman | B01F 3/04262 99/323.1 |
| 2012/0201942 | A1 | 8/2012 | Kilduff et al. | |
| 2012/0211516 | A1 * | 8/2012 | Zapp | B65D 25/48 222/20 |
| 2013/0292857 | A1 | 11/2013 | Connors | |
| 2014/0035172 | A1 * | 2/2014 | Connors | B01F 3/04262 261/30 |
| 2014/0130681 | A1 | 5/2014 | Delgado | |
| 2014/0154383 | A1 | 6/2014 | Beck et al. | |
| 2014/0263461 | A1 * | 9/2014 | Prokop | B01F 7/00133 222/190 |
| 2015/0037479 | A1 | 2/2015 | Lincoln | |
| 2016/0271572 | A1 * | 9/2016 | Li | B01F 15/00253 |
| 2016/0354733 | A1 * | 12/2016 | Chung | B67D 1/10 |

* cited by examiner

Aeration device

Aeration control system

Aeration control unit

AERATION DEVICE

CROSS-REFERENCE TO RELATED APPLICATIONS

This application is a continuation-in-part of U.S. Design Application No. 29/563,220, filed May 3, 2016.

FIELD OF THE INVENTION

The present invention relates generally to the field of aerating liquids, and more particularly to methods, systems, and apparatuses for aerating wine.

BACKGROUND OF THE INVENTION

Decanting is a common method of improving the quality and flavor of a liquid prior to consumption. One method of decanting is aerating, which involves pumping air into the liquid to creating bubbles. Aeration is known to enhance the flavor of liquids, such as wine, and can bring out additional aromas that enhance the drinking experience.

Although aeration is an effective method of decanting most wines, the optimal duration of the aeration varies depending on the type and age of the wine. Additionally, wine aerators are typically either large machines that are not easily portable, or nozzles that plug into a wine bottle while the wine is being poured. Both of these types of wine aerators lack the discretion that a user might prefer, particularly when drinking wine in public such as at a restaurant or a wine bar.

As a result, demand exists for a discrete, portable wine aeration device that allows the user to aerate and otherwise enhance the flavor of wine after it has been poured and control the duration of the aeration.

SUMMARY OF THE INVENTION

The foregoing needs are met, to a great extent, by the present invention, wherein in aspects of this invention, enhancements are provided to the existing model of wine aeration.

In an aspect, an aeration device can include:

a) a housing;

b) a pump module, which is mounted inside the housing, wherein the pump module is configured to provide a fluid flow during an operation of the pump module;

c) a tube connector, which is mounted inside the housing, such that the tube connector is fluidly connected to the pump module;

d) an aerator tube, which is configured to be attachable to the tube connector; and e) a gripping recess, which is mounted inside the housing, such that the aerator tube is receivable within the gripping recess;

wherein the aerator tube is configured to receive the fluid flow from the pump module and deliver the fluid flow to a liquid in a vessel, when the aerator tube is attached to the tube connector.

In related aspects, the aeration device can further include a housing cap, which is configured to be removably attachable to the housing, such that the housing cap is configured to conceal the aerator tube when the aerator tube is received within the gripping recess.

In related aspects, the aeration device can further include an aeration control unit configured to control the operation of the pump module and a plurality of LED lights within the housing.

In related aspects, the aeration device can further include a button accessible from the surface of the housing and configured to allow a user to provide input to an aeration control unit.

In related aspects, the aeration device can further include a first pump module and a second pump module, wherein the first pump module is configured to pump ambient air and the second pump module is configured to pump fluid from a fluid reservoir mounted inside the housing.

In an aspect, an aeration device can include:

a) a housing having a bottom surface;

b) a pump module, which is mounted inside the housing, wherein the pump module is configured to provide a fluid flow during an operation of the pump module;

c) a tube connector, which is mounted inside the housing, such that the tube connector is fluidly connected to the pump module;

d) an aerator tube, which is configured to be attachable to the tube connector;

wherein the aerator tube is configured to receive the fluid flow from the pump module and deliver the fluid flow to a liquid in a drinking glass;

wherein the bottom surface is configured to rest on a top rim of the drinking glass during the operation of the pump module.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
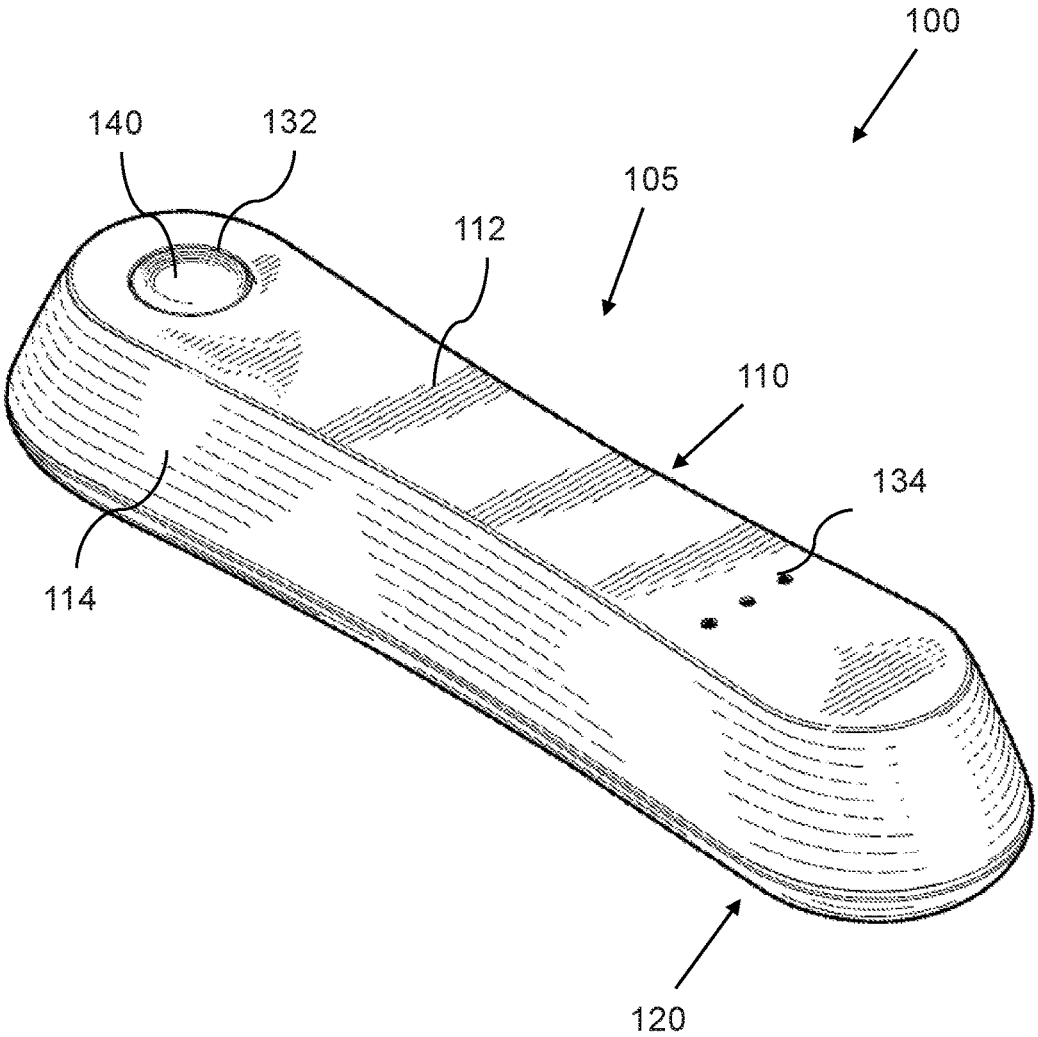
FIG. 1 illustrates a perspective view of an aeration device, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of an aeration device 100 with reference to FIG. 1, in such manner that like reference numerals refer to like components throughout; a convention that we shall employ for the remainder of this specification.

In an embodiment, as shown in FIG. 1, an aeration device 100 includes a housing 105 which can include a top housing part 110 and a bottom housing part (not shown in FIG. 1). In certain embodiments, the housing 105 can include additional housing parts such that the housing 105 comprises three or more housing parts. In other embodiments, the housing 105 can be configured as a monolithic structure.

The aeration device 100 can further include a housing cap 120 which can be attached to the housing 105 such that the housing cap 120 conceals an aerator tube (not shown in FIG. 1) which is secured to the housing 105. The top housing part 110 can include one or more LED apertures 134 and a button aperture 132, wherein the button aperture 132 is configured to circumscribe a button 140.

In a further related embodiment, as shown in FIG. 1, the top housing part 110 can further include a top surface 112 and a side surface 114. The top surface 112 can be configured as a mesh structure that allows the passage of air through the top surface 112, and the side surface 114 can be configured as a contoured surface that slopes or curves from the top surface 112 to the bottom of the top housing part 110, where the top housing part 110 is connected to the housing cap 120.

Figure 2:
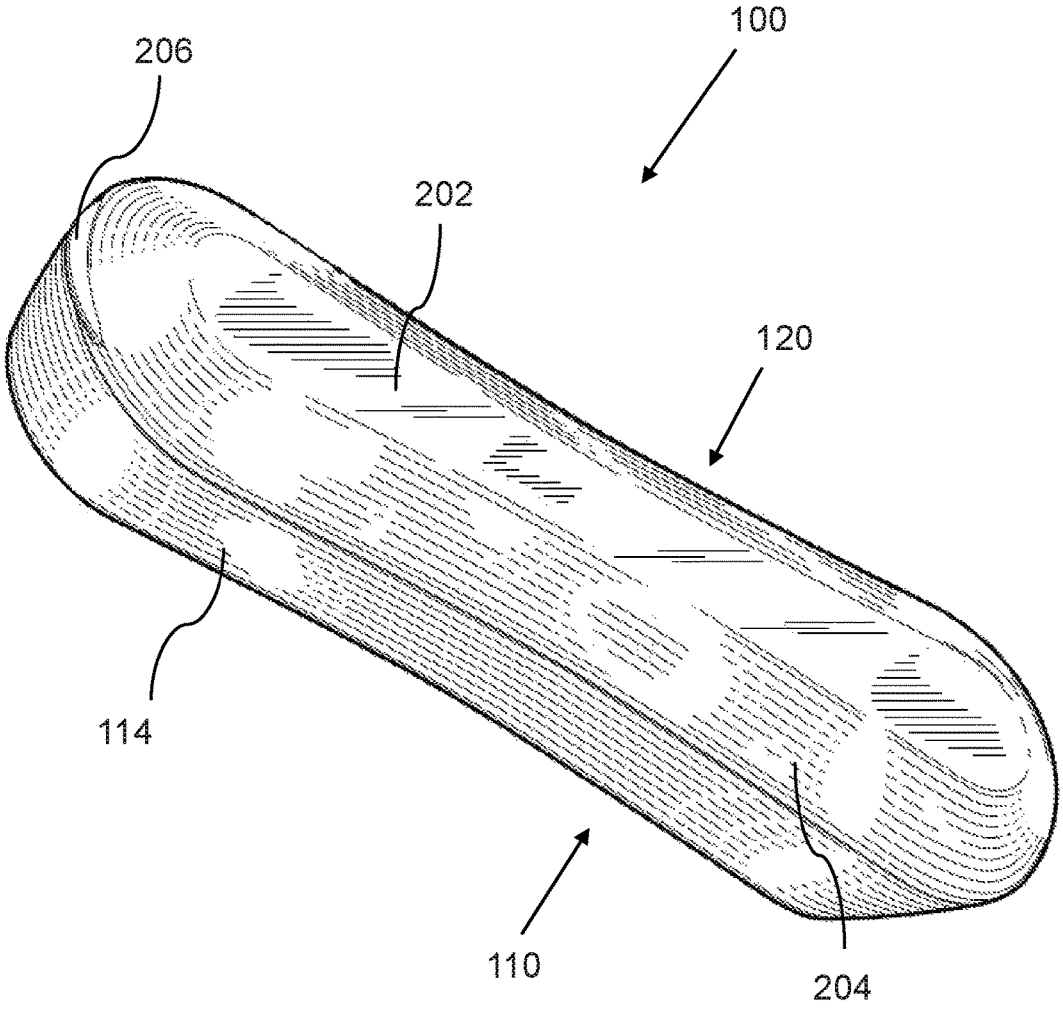
FIG. 2 illustrates a perspective view of an aeration device, according to an embodiment of the invention.

In related embodiment, as shown in FIG. 2, the housing cap 120 can include a bottom flat surface 202 and a bottom side surface 204. The bottom side surface 204 can be configured as a contoured surface that slopes or curves from the bottom flat surface 202 to the bottom of the top housing part 110, where the top housing part 110 is connected to the housing cap 120.

In a further related embodiment, as shown in FIG. 2, the housing cap 120 can include a tab 206 which can be situated at an end of the housing cap 120. The tab 206 can be configured such that a user can push or grab onto the tab 206, to push the housing cap 120 away from the top housing part 110 and thereby remove the housing cap 120 from the aeration device 100.

Figure 3:
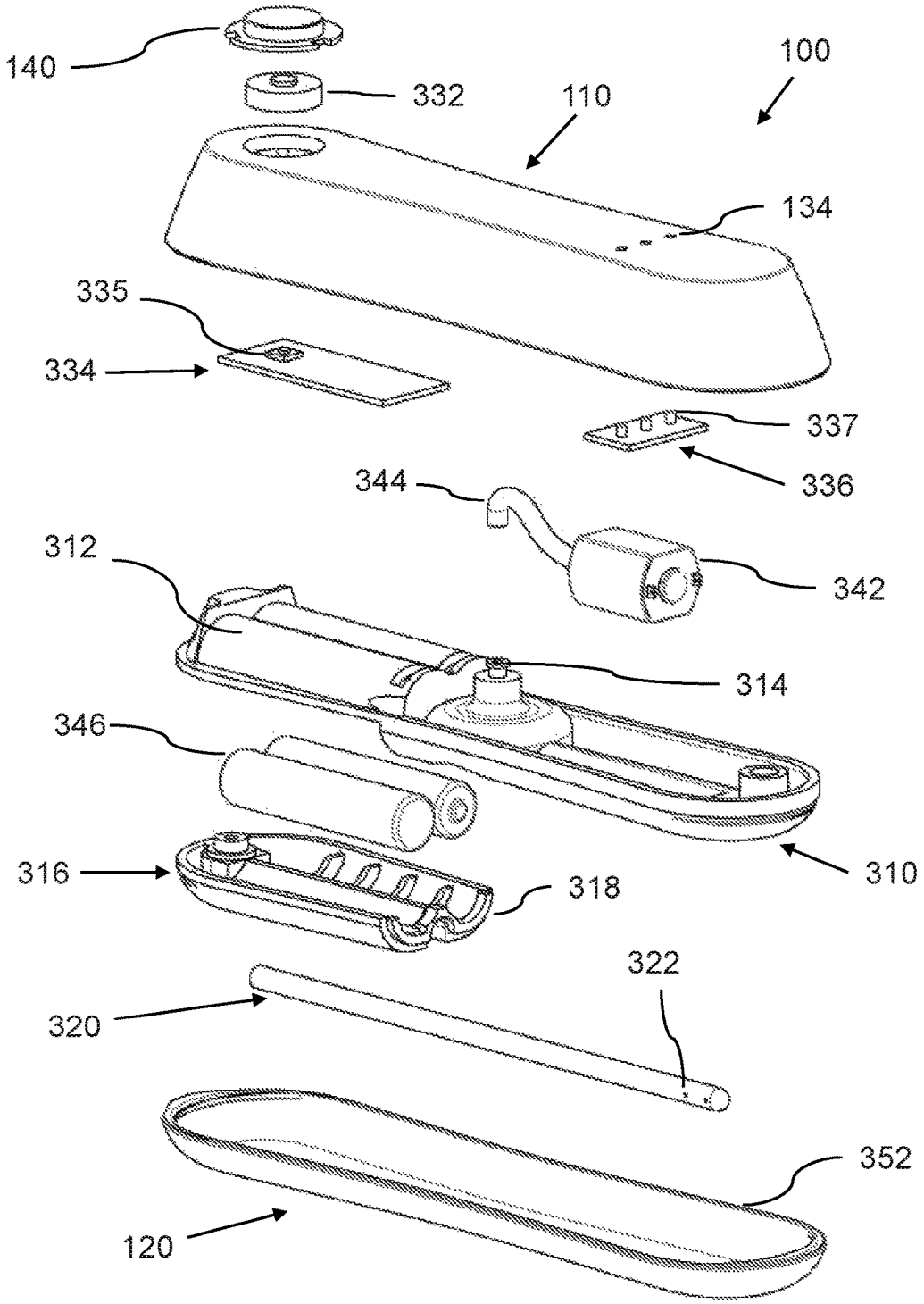
FIG. 3 illustrates an exploded perspective view of an aeration device, according to an embodiment of the invention.

In a related embodiment, FIG. 3 shows an exploded perspective view of the aeration device 100.

In a related embodiment, as shown in FIG. 3, the top housing part 110 can include a spring 332 situated below the button 140. The spring 332 can be configured to transmit a downward force exerted on the button 140 to a switch 335 on a controller. The controller can be configured as a main printed circuit board (PCB) 334 which can control a variety of operations of the aeration device 100, including the power status of the aeration device 100.

In a further related embodiment, as shown in FIG. 3, the main PCB 334 can communicate electrically with a pump module 342 such that the main PCB 334 can control a power setting of the pump module 342, such that the power setting can include the power output of the pump module 342 as well as the duration of the power output. For example, the main PCB 334 can cause the pump module 342 to pump at a predetermined power output for a specified time interval or series of time intervals.

In a further related embodiment, the pump module 342 can be configured to pump air through a pump tube 344. The pump module 342 can have access to a source of ambient air through the air-permeable mesh structure of the top surface 112. In certain embodiments, the pump module 342 can be configured to pump either ambient air or a liquid through the pump tube 344, wherein the liquid may be a flavor enhancer, a color enhancer, or the like. In embodiments wherein the pump module 342 pumps a liquid, the pump module 342 can obtain the liquid from a reservoir located either within the aeration device 100 or outside of the aeration device 100.

In a further related embodiment, the aeration device 100 can be configured such that the pump module 342 is a first pump module 342, and a second pump module 843 (shown in FIG. 8) is also housed in the housing 105. In certain embodiments, the first pump module 342 can be configured to pump ambient air and the second pump module 843 can be configured to pump a liquid from a liquid reservoir, wherein the fluid reservoir can be situated inside the housing 105 or outside the housing 105.

In a related embodiment, as shown in FIG. 3, the aeration device 100 can include an LED PCB 336. The LED PCB 336 can include a plurality of LED lights 337 which can be configured to be seen through the LED apertures 134. The LED PCB 336 can communicate electrically with the main PCB 334 such that the main PCB 334 can control the LED lights 337. For example, the main PCB 334 can control which LED light or lights 337 are turned on for an associated power setting of the pump module 342.

In a related embodiment, as shown in FIG. 3, the housing 105 of the aeration device 100 can further include a bottom housing part 310. The bottom housing part 310 can include an upper tube connector 314 to which the pump tube 344 can be attached.

In a related embodiment, as shown in FIG. 3, the bottom housing part 310 can include an upper battery compartment 312. A battery cap 316, which can be secured to the bottom housing part 310, can include a lower battery compartment 318. The upper and lower battery compartments 312 318 together form a secure enclosure for one or more batteries 346, which can be used to power the aeration device 100, including providing power to the main PCB 334, the LED PCB 336, and the pump module 342.

In a related embodiment, as shown in FIG. 3, the aeration device 100 can include an aerator tube 320 which can be attached to the battery cap 316 and the bottom housing part 310 in a manner described in more detail hereinafter. The aerator tube 320 can include one or more tube apertures 322 through which a fluid such as air or liquid can be pumped by the pump module 342.

In a related embodiment, as shown in FIG. 3, the housing cap 120 can include a housing cap outer rim 352 which goes around the circumference of the housing cap 120. The housing cap outer rim 352 can be configured to allow the housing cap 120 to be attached to the top housing part 110 in a manner described in more detail hereinafter.

Figure 4A:
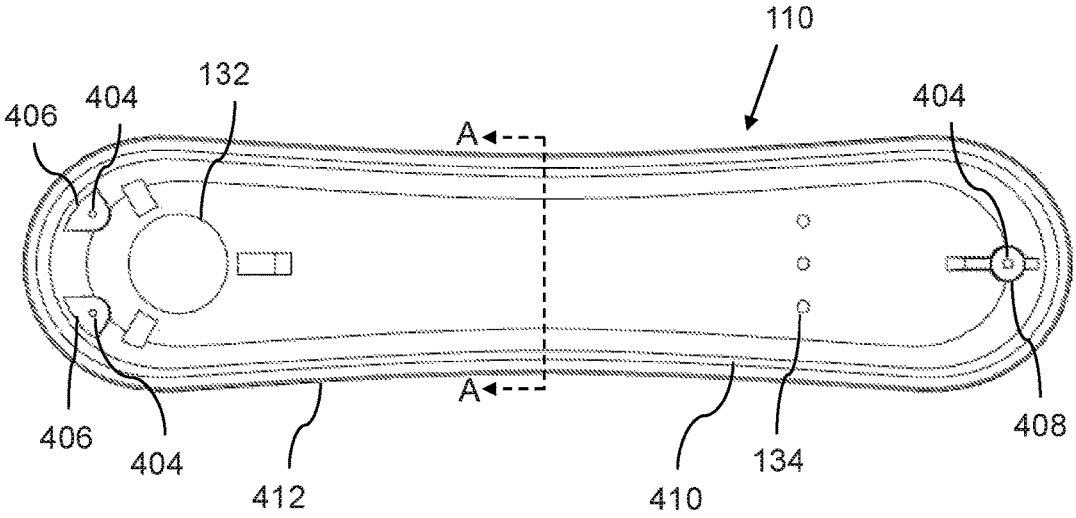
FIG. 4A illustrates a bottom view of a top housing part of an aeration device, according to an embodiment of the invention.

In a related embodiment, as shown in FIG. 4A, the top housing part 110 can include one or more top housing apertures 404 which can be used to attach the bottom housing part 310 to the top housing part 110 in a manner described in more detail hereinafter. In certain embodiments, one or more top housing apertures 404 may be located on one or more aperture plates 406. Similarly, as shown in FIG. 4A, an aperture cylinder 408 can receive a top housing aperture 404, such that the aperture cylinder 408 can be configured to be recessed into the interior of the top housing part 110 relative to the aperture plates 406.

In a further related embodiment, as shown in FIG. 4A, the top housing part 110 can further include a top housing inner rim 410 and a top housing outer rim 412, both of which follow the circumference of the top housing part 110. The top housing outer rim 412 has approximately the same shape and size as the housing cap outer rim 352.

Figure 4B:
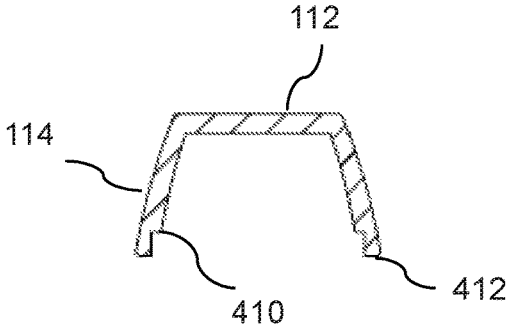
FIG. 4B illustrates a sectional view along the line A-A of FIG. 4A, according to an embodiment of the invention.

In a related embodiment, the top housing outer rim 412 can be configured such that it can receive the housing cap outer rim 352 such that the housing cap outer rim 352 abuts the top housing inner rim 410, as shown in FIGS. 3, 4A and 4B, creating a friction fit between the housing cap outer rim 352 and the top housing outer rim 412 and thereby securing the housing cap 120 to the top housing part 110, as shown in FIGS. 1 and 2. When desired, the friction fit can be overcome by a user of the aeration device 100 by pushing the tab 206 of the housing cap 120 away from the top housing part 110.

In a related embodiment, as shown in FIG. 4B, the top housing inner rim 410 can be configured to be recessed inward into the top housing part 110 relative to the top housing outer rim 412.

Figure 5A:
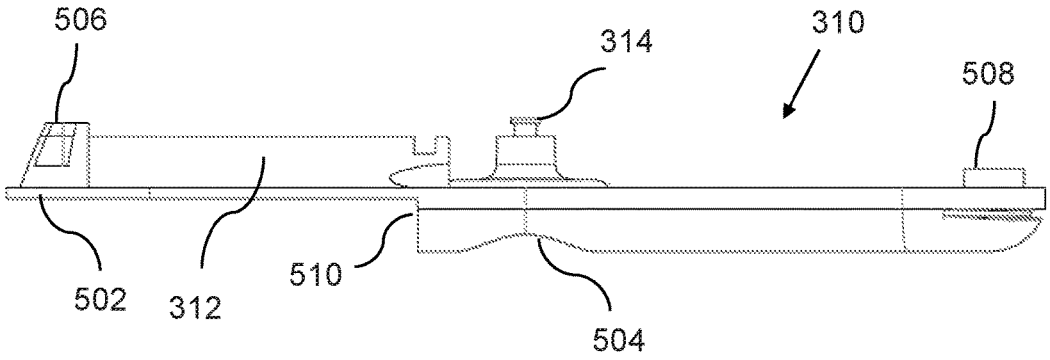
FIG. 5A illustrates a side view of a bottom housing part of an aeration device, according to an embodiment of the invention.

In a related embodiment, as shown in FIG. 5A, the bottom housing part 310 can include an indention section 504 opposite the upper tube connector 314. The bottom housing part 310 can further include a bottom housing surface 502, a female insertion guide 510, a ledge 506, and an aperture projection 508.

Figure 5B:
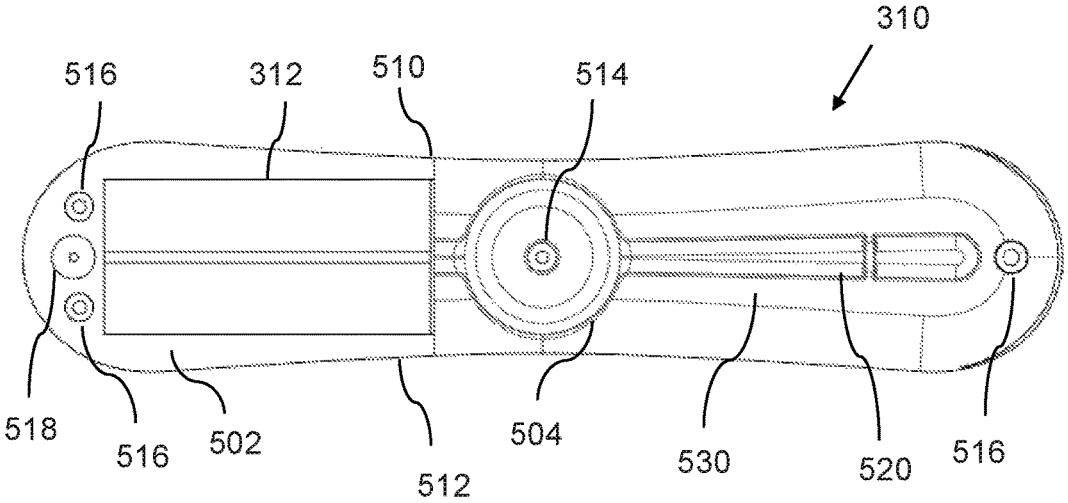
FIG. 5B illustrates a bottom view of a bottom housing part of an aeration device, according to an embodiment of the invention.

In a related embodiment, as shown in FIG. 5B, the indention section 504 can include a lower tube connector 514 which fluidly communicates with the upper tube connector 314. The lower tube connector 514 can be configured to allow a friction fit with the outer surface of the aerator tube 320, thereby connecting the pump module 342 to the aerator tube 320 through the pump tube 344, upper tube connector 314, and lower tube connector 514.

In a further related embodiment, as shown in FIG. 5B, the bottom housing part 310 includes one or more bottom housing apertures 516. The aperture projection 508 can be configured to receive a bottom housing aperture 516, and the bottom housing surface 502 can be configured to receive one or more bottom housing apertures 516.

In a further related embodiment, as shown in FIG. 5B, the bottom housing part 310 can be defined by a bottom housing outer rim 512. The bottom housing outer rim 512 can be configured such when the top housing part 110 and bottom housing part 310 are brought together, the bottom housing outer rim 512 can be received within the top housing outer rim 412 such that the bottom housing surface 502 proximate to the bottom housing outer rim 512 is in contact with the top housing inner rim 410.

In a further related embodiment, as shown in FIG. 5B, when the bottom housing outer rim 512 is received within the top housing outer rim 412, one or more bottom housing apertures 516 can be aligned with corresponding one or more top housing apertures 404. In certain embodiments, the bottom housing apertures 516 and top housing apertures 404 can be configured as threaded apertures such that they can threadedly receive a fastener such as a screw, thereby securing the top housing part 110 to the bottom housing part 310.

In a further related embodiment, the aperture projection 508 can be configured such that when the bottom housing outer rim 512 is received within the top housing outer rim 412, the top surface of the aperture projection 508 is in contact with the recessed aperture cylinder 408 and the bottom housing surface 502 is in contact with the aperture plates 406. In certain embodiments, the aperture projection 508 can be configured to receive the aperture cylinder 408.

In a related embodiment, as shown in FIG. 5B, the bottom housing part 310 includes a first tube gripping recess 520. The first tube gripping recess 520 can be figured such that it receives a portion of the aerator tube 320 in a friction fit. In certain embodiments, as shown in FIG. 5B, the first tube gripping recess 520 may have portions on both sides of the indention section 504.

In a related embodiment, as shown in FIG. 5B, the bottom housing part 310 can include a bottom housing resting surface 530 that can encompass the first tube gripping recess 520.

In a related embodiment, as shown in FIG. 5B, the bottom housing part 310 further includes a battery cap hole 518. The ledge 506 can be configured to receive the battery cap hole 518, as shown in FIGS. 5A and 5B.

Figure 6A:
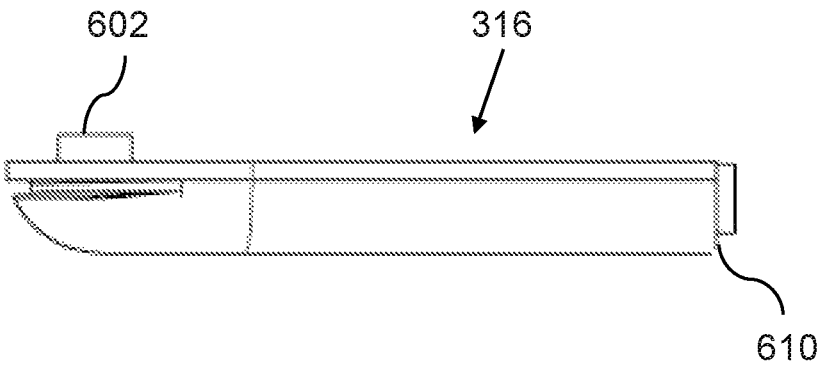
FIG. 6A illustrates a side view of a battery cap of an aeration device, according to an embodiment of the invention.

In a related embodiment, as shown in FIG. 6A, the battery cap 316 includes a male insertion guide 610 and a battery cap projection 602. The male insertion guide 610 can be configured to be received by the female insertion guide 510 of the bottom housing part 310. For example, the male insertion guide 610 can be slidably received by the female insertion guide 510, thereby at least partially securing the battery cap 316 to the bottom housing part 310.

Figure 6B:
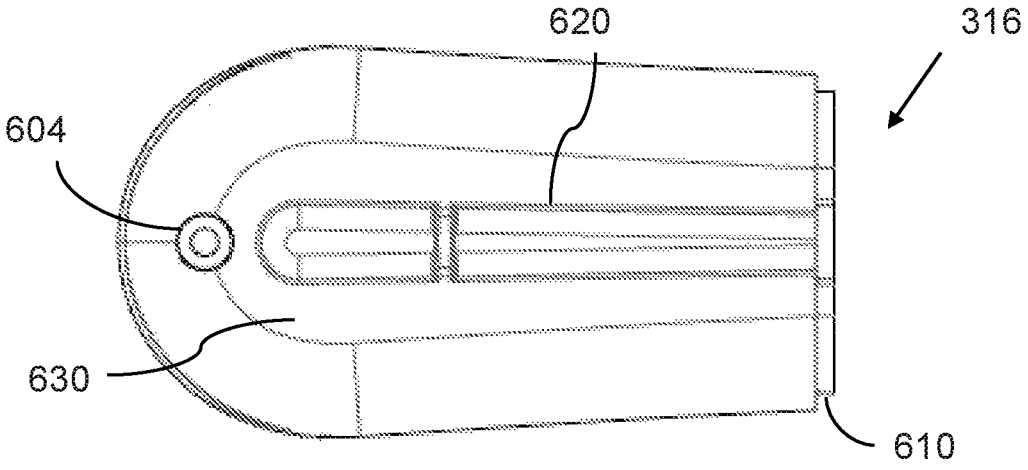
FIG. 6B illustrates a bottom view of a battery cap of an aeration device, according to an embodiment of the invention.

In a related embodiment, as shown in FIG. 6B, the battery cap 316 includes a battery cap aperture 604. In certain embodiments, the battery cap projection 602 can be configured to receive the battery cap aperture 604. When the male insertion guide 610 is inserted into the female insertion guide 510 such that the battery cap 316 is at least partially secured to the bottom housing part 310, the battery cap aperture 604 and the battery cap hole 518 can be aligned. In certain embodiments, the battery cap aperture 604 and the battery cap hole 518 can be threaded such that they can threadedly receive a fastener such as a screw, thereby further securing the battery cap 316 to the bottom housing part 310.

In a related embodiment, as shown in FIG. 6B, the battery cap 316 can further include a second tube gripping recess 620. The second tube gripping recess 620 can be figured such that it receives a portion of the aerator tube 320 in a friction fit, and can cooperate with the first tube gripping recess 520 to allow the aerator tube 320 to be secured and stored within the first and second tube gripping recesses 520 620.

In a related embodiment, the aeration device 100 can be configured such that when the aerator tube 320 is secured within the first and second tube gripping recesses 520 620, and two or more batteries 346 are secured within the upper and lower battery compartments 312 318, the aerator tube 320 is situated at least partially between the two or more batteries 346.

In a related embodiment, as shown in FIG. 6B, the battery cap 316 can include a battery cap resting surface 630 that can encompass the second tube gripping recess 620.

In a related embodiment, when the battery cap 316 has been secured to the bottom housing part 310 and the bottom housing part 310 has further been secured to the top housing part 110, the top housing part 110 and the bottom housing part 310 form the housing 105. When the housing 105 has been assembled, the housing cap 120 can be attached to the bottom of the top housing part 110 in the manner previously described, enclosing the bottom housing part 310 and thereby concealing the aerator tube 320 from view. The aeration device 100 thus assembled, as shown in FIG. 1, provides a sleek and aesthetically-pleasing structure that can be handled discretely by a user while simultaneously preventing the aerator tube 320 from being lost when the aeration device 100 is not in use.

Figure 7:
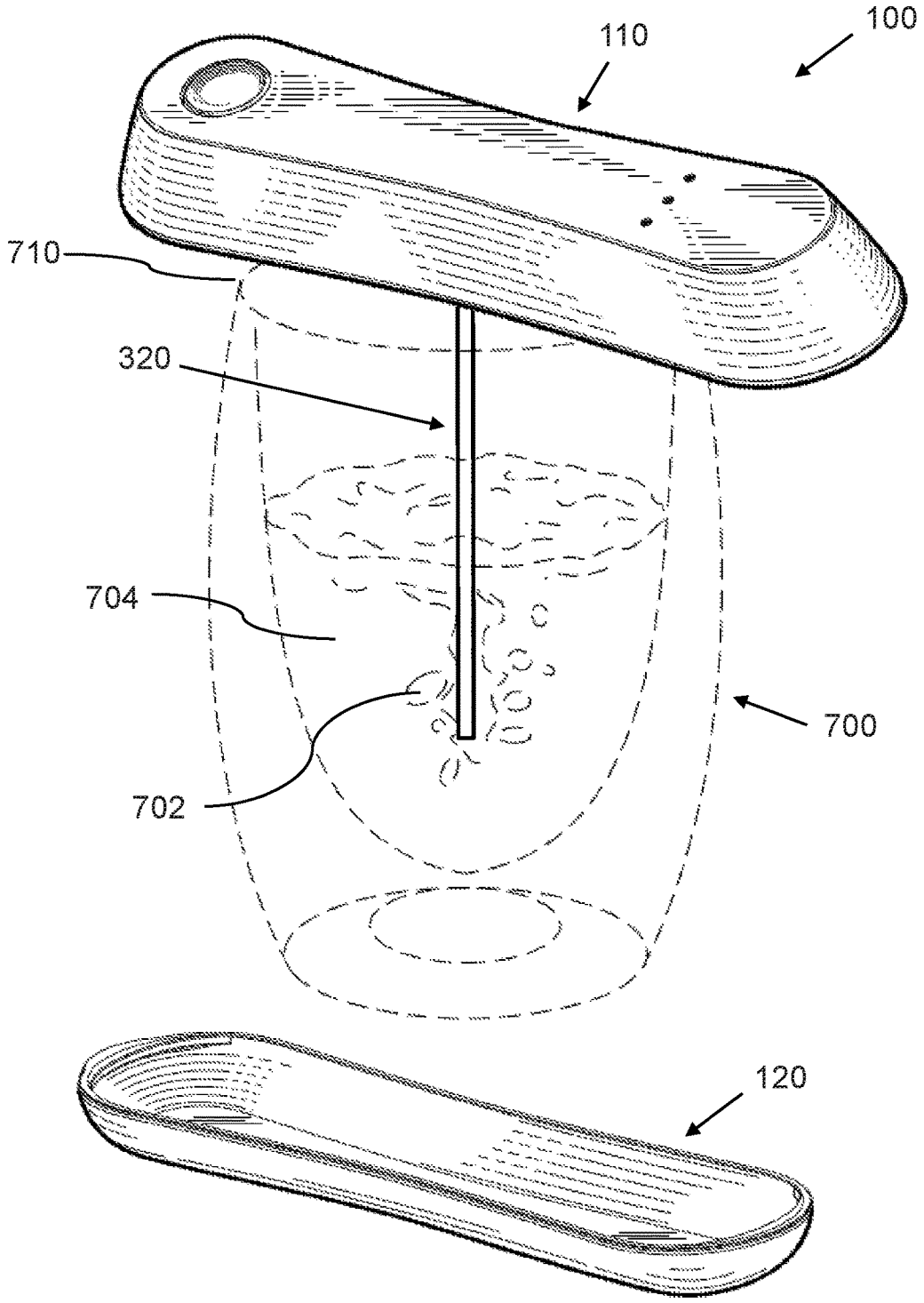
FIG. 7 illustrates a perspective view of an aeration device in use, according to an embodiment of the invention.

In a related embodiment, as shown in FIG. 7, the aeration device 100 can be configured to rest on a vessel 700, such as a drinking glass 700, during operation. Specifically, the housing cap 120 can be removed such that bottom housing resting surface 530 and the battery cap resting surface 630 can support the aeration device 100 on a top rim 710 of the vessel 700.

In a related embodiment, the aerator tube 320 can be configured to attach to the lower tube connector 514 such that the bottom of the aerator tube 320 protrudes downward into the vessel 700 and submerges into a liquid 704 in the vessel 700. When the first pump module 342 is powered on, the aeration device 100 can produce bubbles of air 702 from the bottom of the aerator tube 320, thereby aerating the liquid 704 contained within the vessel 700.

In a related embodiment, the aeration device 100 can be configured to pump a flavor enhancing liquid out of the aerator tube 320 via the second pump module 843, such that the liquid 704 is aerated while simultaneously mixing with the flavor enhancing liquid.

Figure 10:
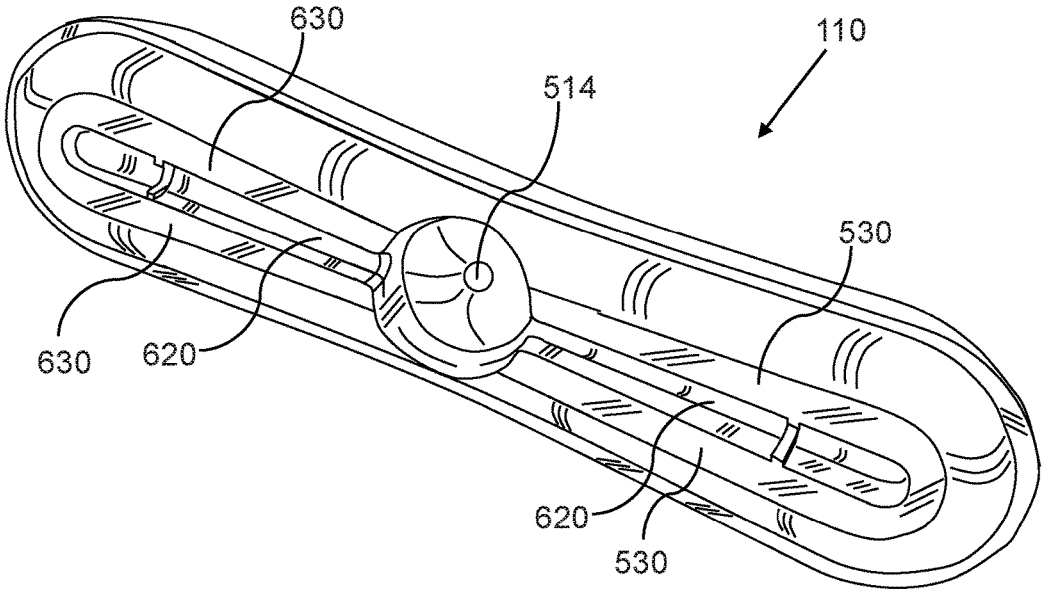
FIG. 10 illustrates a bottom perspective view of an aeration device with a housing cap and an aerator tube removed, according to an embodiment of the invention.

In a related embodiment, FIG. 10 shows a bottom perspective view of the aeration device 100 with the housing cap 120 and the aerator tube 320 removed. As shown in FIG. 10, the bottom housing resting surface 530 of the bottom housing part 310 can be configured to include a substantially flat surface portion 630 530 or portions 630 530, that is configured to allow the aeration device 100 with the housing cap 120 removed, to rest on a rim of a drinking glass. Similarly, the battery cap resting surface 630 of the battery cap 316 can be configured as a substantially flat surface portion 630. When the aeration device 100 is placed on a vessel 700 as shown in FIG. 7, the bottom housing resting surface 530 and the battery cap resting surface 630 come into contact with the top rim 710 of the vessel such that the aeration device 100 can rest stably on the top rim 710 without further user intervention.

Figure 8:
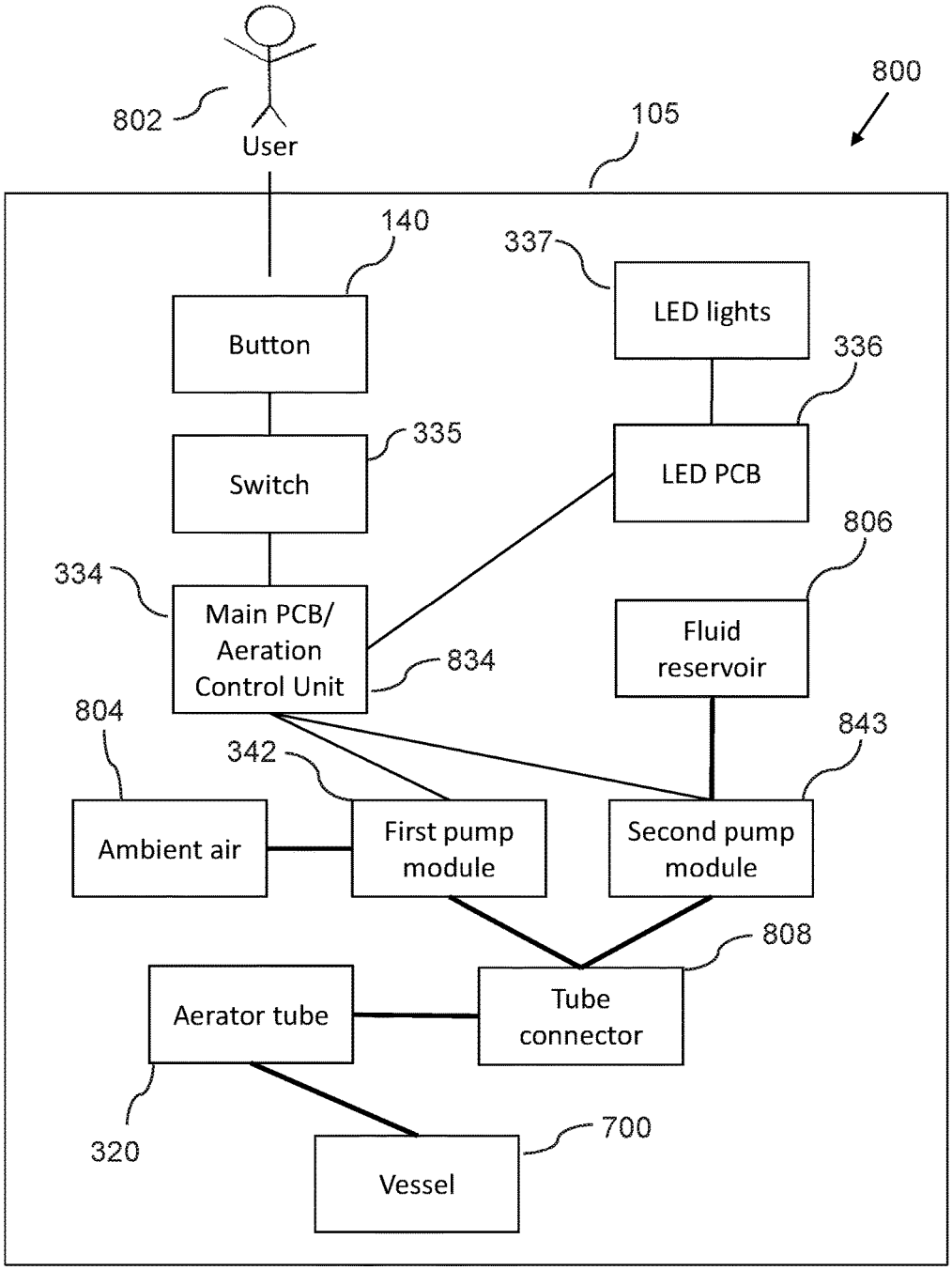
FIG. 8 is a block diagram illustrating an aeration control system, according to an embodiment of the invention.

In a related embodiment, as shown in FIG. 8, an aeration control system 800 can include a main PCB 334, which is electrically connected to a first pump module 342 and a second pump module 843, such that the main PCB 334 can be configured to control activation of the first pump module 342 and/or the second pump module 843. The main PCB 334 can receive input from a user 802 via a button 140 which can contact a switch 335 on the main PCB 334, thereby allowing the user 802 to control the first and second pump modules 342 843. The main PCB 334 is further electrically connected to the LED PCB 336, which is electrically connected to one or more LED lights 337.

In a further related embodiment, the main PCB 334 can include a processor, such that the main PCB 334 is configured as an aeration control unit 834.

In a further related embodiment, as shown in FIG. 8, the first pump module 342 is fluidly connected to the aerator tube 320 and to a source of ambient air 804, such as through the mesh structure of the top surface 112 of the top housing part 110. Furthermore, the second pump module 843 is fluidly connected to both the aerator tube 320 and to a fluid reservoir 806, which may hold a fluid intended to change a quality or qualities of a liquid, such as its flavor or color.

In a further related embodiment, the aerator tube 320 is fluidly connected to the vessel 700 through a tube connector 808. The tube connector 808 can comprise an upper tube connector 314 and a lower tube connector 514, and can further comprise a one-way valve, as is well-known in the art, which permits air 804 or fluid from the fluid reservoir 806 to flow only from the pump modules 342 843 to the aerator tube 320.

In a related embodiment, after receiving a first command from a user 802, the main PCB 334 can control the first pump module 342 to draw in ambient air 804 and pump the ambient air 804 through the aerator tube 320 and into the vessel, thereby aerating the liquid 704 in the vessel 700.

In a related embodiment, after receiving a second command from a user 802, the main PCB 334 can control the second pump module 342 to draw fluid from the fluid reservoir 806 and pump the fluid through the aerator tube 320 and into the vessel 700, thereby aerating the liquid 704 in the vessel 700. Depending on the type of fluid in the fluid reservoir 806, the fluid may have an additional effect on the liquid 704 in the vessel 700, such as changing the flavor of the liquid 704.

In a related embodiment, the first pump module 342 and the second pump module 843 can be configured to operate simultaneously and pump both ambient air 804 and fluid from the fluid reservoir 806 through one or more aerator tubes 320.

In a related embodiment, based on the commands received by the main PCB 334, the main PCB 334 can control the LED PCB 336 to turn one or more of the LED lights 337 on or off. In certain embodiments, the functions of the LED PCB 336 can be combined with the main PCB 334 such that main PCB 334 directly controls the operation of the LED lights 337, thereby eliminating the need for the LED PCB 336.

In a related embodiment, the aeration device 100 can include a single pump module 342 that is fluidly connected to both a source of ambient air 804 and a fluid reservoir 806, wherein the single pump module 342 is capable of pumping either air or fluid from the fluid reservoir 806.

In a related embodiment, the aeration device 100 can include a separate tube connector for each pump module, e.g., the first pump module 342 is fluidly connected to a first tube connector and the second pump module 843 is fluidly connected to a second tube connector. Furthermore, the aeration device 100 can include a separate aerator tube 320 for each tube connector.

Figure 9:
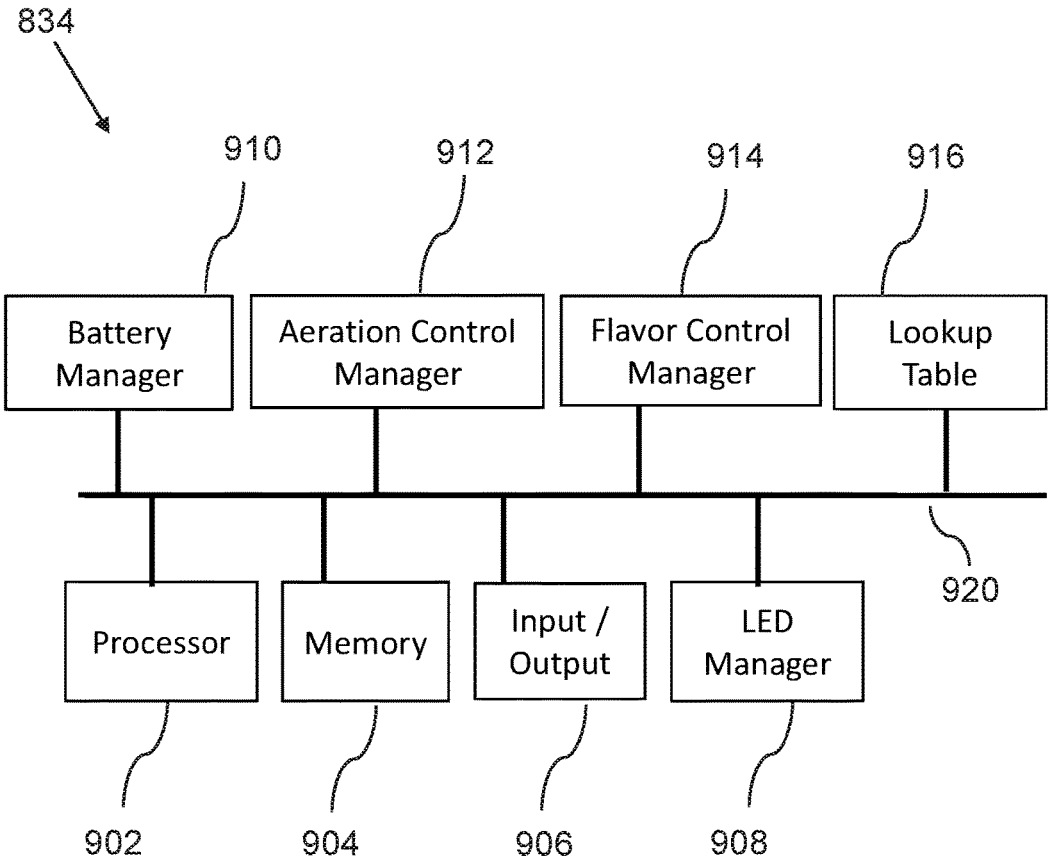
FIG. 9 is a block diagram illustrating an aeration control unit, according to an embodiment of the invention.

In a related embodiment, as shown in FIG. 9, an aeration control unit 834 can include:

a) a processor 902;
b) a non-transitory memory 904;
c) an input/output component 906;
d) an LED manager 908;
e) a battery manager 910;
f) an aeration control manager 912;
g) a flavor control manager 914; and
h) an aeration table 916; all connected via
i) a data bus 920.

In a related embodiment, the elements of the aeration control unit 834 can all be located on the main PCB 334, such that the main PCB 334 is configured as an aeration control unit 834. In certain embodiments, the elements of the aeration control unit 834 can be split between the main PCB 334 and the LED PCB 336.

In a related embodiment, the aeration control unit 834 can receive input 906 from a user via the button 140 in the form of a downward force on the button 140 that is registered by the switch 335 on the main PCB 334. The aeration control manager 912 can have a certain number of modes, and can be configured such that a certain number of inputs from the button correspond to an associated mode within the aeration control manager 912.

In a nonlimiting example, the aeration control manager 912 be configured to have three modes, wherein each mode is intended for use with different types of wine. One press of the button 140 can instruct the aeration control manager 312 to turn on the first pump module 342 for a specified duration, such as 15 seconds, related to the first mode. Another press of the button 140 during the first mode operation activates the second mode, which automatically adds a specified duration, such as another 15 seconds, to the first 15 second duration for a total of 30 seconds. Similarly, another press of the button 140 during the second mode operation time activates the third mode, which automatically adds another 15 seconds to the previous 30 second duration for a total of 45 seconds. The aeration control manager 912 can be programmed with a number of subsequent modes, or it can be programmed to cut power to the first pump module 342 if the button 140 is pressed a fourth time during the operation of the third mode.

In a related embodiment, the aeration table 916 can be configured as a lookup table that correlates predetermined identifier fields with predetermined operation modes, such that the aeration control manager 912 is configured to operate according to the operation mode that is associated with selected identifier fields. The aeration control manager 912 can choose a specific operation mode based on input of identified fields received from a user via the input/output component 906. Operation modes can comprise various aspects of the operation of the aeration device 100, such as the intensity of the pumping, for example measured in volume per second, and the duration of the operation, for example measured in seconds, including pulsing modes.

In a further related embodiment, the aeration table 916 can be configured to include a sequence of records, each record including:

a) identifier fields, which can include identifying features of drinks such as:
i. name;
ii. age;
iii. type;
iv. category;
v. color; and
vi. brand; and
b) an operation mode, which can include a sequence of:
i. pumping operations, including:
1. Pumping Duration; and optionally
2. Intensity; or
ii. Pauses, further including
3. Pause Duration.

In a further related example embodiment, a user desiring to drink a glass of wine can input the identifying age and color of the wine into the aeration device 100, whereupon the aeration control manager 912 can use the aeration table 916 to find the proper operation mode for a wine that matches the identifier fields. For example, the aeration table can be configured such that the identifier fields name: "Beaujolais nouveau" and age: 2 are associated with an operation mode, including a sequence of 3 pumping operations of 30 seconds duration at medium intensity, with intermittent pauses of 10 seconds, then a 180 second pause, and a final 5 second pumping operation. The aeration table 916 can further be configured to automatically calculate the age of a drink based on the year it was manufactured.

In a related embodiment, the input/output component 906 can comprise the button 140, spring 332, and switch 335, as previously described. However, in certain embodiments, the input/output component 906 can be configured to communicate with a wireless network, such as Bluetooth, WiFi, NFC, and the like, via a wireless antenna, as is well-known in the art. Such a configuration can allow the input/output component 906 to receive input from a wireless device, as well as output data to a wireless device. For example, the input/output component 906 can be configured to receive operation instructions from a user via an application on a smartphone. Likewise, the input/output component 906 can be configured to send real-time status data to a user's smartphone.

In a related embodiment, the LED manager 908 can be programmed to supply power to one or more of the LED lights 337 depending on what mode of operation the aeration control manager 912 is in. In certain embodiments, each LED light 337 corresponds to a specific mode of operation of the aeration control manager 912 such that only one LED light 337 is lit during operation of the aeration device 100. In other embodiments, each LED light 337 corresponds to a specified time interval such that for every additional time duration added to the operation of the aeration control manager 912, an additional LED light 337 turns on, i.e., each press of the button 140 equals an additional LED light indicator.

In a related embodiment, once power is cut to the pump module 342 by the aeration control manager 912, whether by the operation time naturally running out or the operation cut short by a final press of the button 140, the LED lights 337 can be configured to go out.

In a related embodiment, the LED lights 337 can be configured to shine in a plurality of colors, with a specific color being controlled by the LED manager 908. In certain embodiments, LED manager 908 can communicate electrically with the aeration control manager 912 such that the color of each LED light 337 can be related to the type of wine being aerated, e.g., the first LED light 337 can be white, the second LED light 337 can be light red, the third LED light 337 can be dark red, etc.

In a related embodiment, the LED manager 908 can communicate electrically with the battery manager 910 such that the LED lights 337 shine a certain color or a specific duration depending on the amount of power remaining in the batteries 346. For example, the LED lights 337 can blink in a blue color whenever the batteries 346 are running low.

In a related embodiment, the flavor control manager 914 can control the second pump module 843 to pump out a flavor enhancing liquid into the vessel 700. Similar to the aeration control manager 912, the flavor control manager 914 can be controlled by a user using a button 140 to specify the duration of operation of the second pump module 843 and/or which flavor enhancing liquid of a plurality of flavor enhancing liquids to add to the vessel 700.

FIGS. 8 and 9 are block diagrams according to various embodiments of the present invention. It shall be understood that each block or step of the block diagram can be implemented by computer program instructions or other means. Although computer program instructions are discussed, an apparatus or system according to the present invention can include other means, such as hardware or some combination of hardware and software, including one or more processors or controllers, for performing the disclosed functions.

In this regard, FIG. 9 depicts the computer devices of various embodiments, each containing several of the key components of a general-purpose computer by which an embodiment of the present invention may be implemented. Those of ordinary skill in the art will appreciate that a computer can include many components. However, it is not necessary that all of these generally conventional components be shown in order to disclose an illustrative embodiment for practicing the invention. The general-purpose computer can include a processing unit and a system memory, which may include various forms of non-transitory storage media such as random access memory (RAM) and read-only memory (ROM). The computer also may include nonvolatile storage memory, such as a hard disk drive, where additional data can be stored.

It shall be understood that the above-mentioned components of the aeration control unit 834 are to be interpreted in the most general manner.

For example, the processor 902 can include a single physical microprocessor or microcontroller, a cluster of processors, a datacenter or a cluster of datacenters, a computing cloud service, and the like.

In a further example, the non-transitory memory 904 can include various forms of non-transitory storage media, including random access memory and other forms of dynamic storage, and hard disks, hard disk clusters, cloud storage services, and other forms of long-term storage. Similarly, the input/output 906 can include a plurality of well-known input/output devices, such as screens, keyboards, pointing devices, motion trackers, communication ports, and so forth.

An embodiment of the present invention can also include one or more input or output components, such as a mouse, keyboard, monitor, and the like. A display can be provided for viewing text and graphical data, as well as a user interface to allow a user to request specific operations. Furthermore, an embodiment of the present invention may be connected to one or more remote computers via a network interface. The connection may be over a local area network (LAN) wide area network (WAN), and can include all of the necessary circuitry for such a connection.

In a related embodiment, the aeration control unit 834 communicates with a network, which can include the general Internet, a Wide Area Network or a Local Area Network, or another form of communication network, transmitted on wired or wireless connections. Wireless networks can for example include Ethernet, Wi-Fi, Bluetooth, ZigBee, and NFC. The communication can be transferred via a secure, encrypted communication protocol.

Typically, computer program instructions may be loaded onto the computer or other general-purpose programmable machine to produce a specialized machine, such that the instructions that execute on the computer or other programmable machine create means for implementing the functions specified in the block diagrams, schematic diagrams or flowcharts. Such computer program instructions may also be stored in a computer-readable medium that when loaded into a computer or other programmable machine can direct the machine to function in a particular manner, such that the instructions stored in the computer-readable medium produce an article of manufacture including instruction means that implement the function specified in the block diagrams, schematic diagrams or flowcharts.

In addition, the computer program instructions may be loaded into a computer or other programmable machine to cause a series of operational steps to be performed by the computer or other programmable machine to produce a computer-implemented process, such that the instructions that execute on the computer or other programmable machine provide steps for implementing the functions specified in the block diagram, schematic diagram, flowchart block or step.

Accordingly, blocks or steps of the block diagram, flowchart or control flow illustrations support combinations of means for performing the specified functions, combinations of steps for performing the specified functions and program instruction means for performing the specified functions. It will also be understood that each block or step of the block diagrams, schematic diagrams or flowcharts, as well as combinations of blocks or steps, can be implemented by special purpose hardware-based computer systems, or combinations of special purpose hardware and computer instructions, that perform the specified functions or steps.

As an example, provided for purposes of illustration only, a data input software tool of a search engine application can be a representative means for receiving a query including one or more search terms. Similar software tools of applications, or implementations of embodiments of the present invention, can be means for performing the specified functions. For example, an embodiment of the present invention may include computer software for interfacing a processing element with a user-controlled input device, such as a mouse, keyboard, touch screen display, scanner, or the like. Similarly, an output of an embodiment of the present invention may include, for example, a combination of display software, video card hardware, and display hardware. A processing element may include, for example, a controller or microprocessor, such as a central processing unit (CPU), arithmetic logic unit (ALU), or control unit.

Here has thus been described a multitude of embodiments of the aeration device, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent, and should be considered fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. An aeration device, comprising:

a) a housing;

b) a pump module, which is mounted inside the housing, wherein the pump module is configured to provide a fluid flow during an operation of the pump module;

c) a tube connector, which is mounted inside the housing, such that the tube connector is fluidly connected to the pump module;

d) an aerator tube, which is configured to be attachable to the tube connector; and e) a gripping recess, which is mounted inside the housing, such that the gripping recess is configured to receive the aerator tube, when the aerator tube is positioned for storage;

wherein the aerator tube is configured to receive the fluid flow from the pump module and deliver the fluid flow to a liquid in a vessel, when the aerator tube is attached to the tube connector;

wherein an attached position of the aerator tube, when the aerator tube is attached to the tube connector, is perpendicular to a stored position of the aerator tube, when the aerator tube is positioned for storage.

2. The aeration device of claim 1, further comprising a housing cap, which is configured to be removably attachable to the housing, such that the housing cap is configured to conceal the aerator tube when the aerator tube is received within the gripping recess, whereby the aeration device is configured to store and conceal the aerator tube inside the housing when the aeration device is not in use.

3. The aeration device of claim 1, wherein the aeration device is configured to rest on a top rim of a drinking glass during the operation of the pump module, such that the vessel is the drinking glass.

4. The aeration device of claim 1, further comprising a plurality of LED lights, which are mounted inside the housing, such that the plurality of LED lights are viewable through a plurality of apertures in the housing.

5. The aeration device of claim 1, wherein the pump module is configured to pump ambient air.

6. The aeration device of claim 1, further comprising a fluid reservoir that is configured to contain a fluid, such that the fluid reservoir is mounted inside the housing, wherein the pump module is fluidly connected to the fluid reservoir, such that the pump module is configured to pump the fluid.

7. The aeration device of claim 1, wherein the pump module is a first pump module, and the aeration device further comprises a second pump module, which is mounted within the housing.

8. The aeration device of claim 7, further comprising a fluid reservoir that is configured to contain a fluid, such that the fluid reservoir is mounted inside the housing, wherein the second pump module is fluidly connected to the fluid reservoir, wherein the first pump module is configured to pump ambient air and the second pump module is fluidly connected to the tube connector and configured to pump the fluid from the fluid reservoir.

9. The aeration device of claim 7, wherein the tube connector is a first tube connector, and the housing further comprises a second tube connector, wherein the second pump module is fluidly connected to the second tube connector.

10. The aeration device of claim 1, further comprising at least two batteries, which are mounted within the housing, wherein the aerator tube is located at least partially between the at least two batteries when the aerator tube is secured within the gripping recess.

11. The aeration device of claim 1, further comprising a button, which is mounted on an outer surface of the housing, wherein the aeration control unit is configured to receive input from the button to control the operation of the pump module.

12. The aeration device of claim 1, wherein a top surface of the housing comprises an air-permeable mesh structure.

13. An aeration device, comprising:

a) a housing;

b) a first pump module, which is mounted inside the housing, wherein the first pump module is configured to provide a fluid flow during an operation of the first pump module;

c) a first tube connector, which is mounted inside the housing, such that the first tube connector is fluidly connected to the first pump module;

d) an aerator tube, which is configured to be attachable to the first tube connector; and e) a second pump module, which is mounted within the housing;

wherein the aerator tube is configured to receive the fluid flow from the first pump module and deliver the fluid flow to a liquid in a vessel, when the aerator tube is attached to the first tube connector.

14. The aeration device of claim 13, further comprising a fluid reservoir that is configured to contain a fluid, such that the fluid reservoir is mounted inside the housing, wherein the second pump module is fluidly connected to the fluid reservoir, wherein the first pump module is configured to pump ambient air.

15. The aeration device of claim 14, wherein the housing further comprises a second tube connector, wherein the second pump module is fluidly connected to the second tube connector and configured to pump the fluid from the fluid reservoir.

* * * * *